United States Patent [19]

Anno et al.

[11] Patent Number: 4,935,617

[45] Date of Patent: Jun. 19, 1990

[54] X-RAY IMAGE INTENSIFIER AND METHOD OF MANUFACTURING THE SAME

[75] Inventors: Hidero Anno, Ootawara; Katsuhiro Ono, Kawasaki, both of Japan

[73] Assignee: Kabushiki Kaisha Toshiba, Kawasaki, Japan

[21] Appl. No.: 315,804

[22] Filed: Feb. 27, 1989

[30] Foreign Application Priority Data

Mar. 4, 1988 [JP] Japan ..... 63-49639
Dec. 27, 1988 [JP] Japan ..... 63-327585

[51] Int. Cl.[5] ..... H01J 31/50
[52] U.S. Cl. ..... 250/213 VT; 313/527
[58] Field of Search ..... 250/213 VT; 313/527, 313/530, 541–544

[56] References Cited

U.S. PATENT DOCUMENTS 3,089,956 5/1963 Hushley ..... 250/213 VT
3,783,298 1/1974 Houston ..... 250/213 VT
4,740,683 4/1988 Noji et al. ..... 313/527

FOREIGN PATENT DOCUMENTS 52-93265 8/1977 Japan .
59-24300 2/1984 Japan .
63-88732 4/1988 Japan .

*Primary Examiner*—David C. Nelms
*Attorney, Agent, or Firm*—Cushman, Darby & Cushman

[57] ABSTRACT

An X-ray image intensifier comprising a vacuum envelope and an input screen having an improved sensitivity and including a substrate disposed on the X-ray input side of the vacuum envelope, a phosphor layer formed on the substrate and a photocathode formed on the phosphor layer. The phosphor layer consists of columnar crystals extending in a direction perpendicular to the substrate surface. The tip portions of the columnar crystals are deformed to close the upper portion of the clearances formed between the columnar crystals.

19 Claims, 5 Drawing Sheets

X-RAY IMAGE INTENSIFIER AND METHOD OF MANUFACTURING THE SAME

BACKGROUND OF THE INVENTION

1. Field of the Invention

The present invention relates to an X-ray image intensifier, particularly, to an improvement in the input screen of the X-ray image intensifier.

2. Description of the Related Art

FIG. 1A shows the input screen of a conventional X-ray image intensifier. As seen from the drawing, the input screen comprises input substrate 31 having a smooth surface, a first phosphor layer consisting of CsI:Na crystal grains formed on input substrate 31 by vapor deposition under a low degree of vacuum, second phosphor layer 34 consisting of CsI:Na crystal grains grown in a columnar shape on the first phosphor layer, surface layer 35 consisting of CsI:Na phosphor formed on the second phosphor layer 34 by vacuum deposition under a high degree of vacuum, and a photocathode 36.

Second phosphor layer 34 consists of columnar CsI crystals grown in a direction substantially perpendicular to the surface of input substrate 31. Columnar crystals have an average diameter of 5 to 50 microns and a length of about 400 microns. The columnar crystals are separated from each other by fine clearance 33. When photocathode 36 is formed directly on the surface of the second phosphor layer 34 consisting of the columnar crystals, photocathode 36 is also divided into fine island-shaped regions. In photocathode 36 of this shape, an electric connection cannot be achieved in a direction parallel to the surface of photocathode 36. It follows that it is impossible to maintain constant the potential of photocathode 36 with increase in the number of photoelectrons emitted from photocathode 36. As a result, the electrooptic uniformity of the X-ray image intensifier is markedly impaired, leading to distortion of the output image or reduction of resolution.

To overcome the difficulty, surface layer 35 is formed on second phosphor layer 34, followed by forming photocathode 36 on surface layer 35. Since surface layer 35 has a relatively continuous surface, photocathode 36 formed on surface layer 35 also has a relatively continuous surface, with the result that it is possible to ensure an electric connection in a direction parallel to the surface of photocathode 36.

However, clearances 33 formed between the individual columnar crystals in second phosphor layer 34 include relatively large clearances 34, sized about 1 micron, which are distributed over the entire region of second phosphor layer 34, as shown in FIG. 1B. As a result, pin holes 37 corresponding to relatively large clearances 33 are formed in surface layer 35. These pin holes 37 give a detrimental effect to the sensitivity of photocathode 36. Specifically, the material of photocathode 36 is gradually diffused through pin holes 37 into the phosphor layer in the step of forming photocathode 36 which is carried out at such a high temperature as 100° C. or more, leading to a low sensitivity of the photocathode formed. The diffusion also takes place even after completion of the step for forming photocathode 36. Accordingly, the sensitivity of the photocathode is gradually lowered, leading to a shortened life of the input sereen.

It is possible to diminish pin holes 37 and to decrease the number of pin holes 37 by increasing the thickness of surface layer 35. As a result, the sensitivity of photocathode 36 can be improved. However, the increased thickness of surface layer 35 brings about a low resolution of the input screen, leading to a low resolution of the X-ray image intensifier. Under the circumstances, the thickness of surface layer 35 is practically set at about 10 to 30 microns.

It should also be noted that photocathode 36 itself has a high electric resistance in some cases depending on the materials of photocathode 36, making it impossible to put the input screen into practical use even if photocathode 36 is formed on surface layer 35 having a relatively continuous surface. In this case, a conductive intermediate layer is formed between surface layer 35 and photocathode 36. The conductive intermediate layer should desirably be highly transparent. An indium oxide film or an indium tin oxide film is known as a desirable material of the conductive intermediate layer. Even in the case of using such a conductive film, however, it is necessary to set the thickness of the intermediate layer at 0.3 micron or less in order to obtain a high enough transmittance in ($\gtrsim$70%) CsI phosphor layer activated by Na. It follows that the use of a conductive intermediate layer is quite incapable of eliminating the pin holes present in the surface layer. Also, it is quite impossible to solve the problem even if the surface layer is formed by vapor deposition of a transparent material other than the phosphor.

Japanese Patent Disclosure No. 63-88732 teaches the idea of shaving the surface region of a first CsI phosphor film consisting of completely dispersed phosphor particles, followed by forming a second CsI phosphor layer by vapor deposition on the shaved surface of the first CsI phosphor film so as to provide a continuous phosphor layer surface. However, it is difficult to prevent the pin hole occurrence by the technique of this prior art.

As described above, the phosphor layer surface in the input screen of a conventional X-ray image intensifier is not sufficient continuous, but contains a large number of pin holes. The presence of the pin holes makes it difficult to form a photocathode having a high sensitivity and a long life.

SUMMARY OF THE INVENTION

The present invention is intended to overcome the above-noted problem inherent in the prior art so as to provide an X-ray image intensifier comprising an photocathode having a high sensitivity and a long life and to provide a method of manufacturing the same.

According to the present invention, there is provided an X-ray image intensifier, comprising a vacuum envelope and an input screen including a substrate disposed on the X-ray input side of the vacuum envelope, a phosphor layer formed on the substrate, said phosphor layer consisting of columnar crystals extending in a direction perpendicular to the substrate surface, and a photocathode formed on the phosphor layer, the tip portions of said columnar crystals being deformed to close the upper portions of the clearances formed between the columnar crystals. In the X-ray image intensifier of the present invention, the columnar crystals have a larger cross sectional area in the tip portion than in the other portion such that the adjacent columnar crystals are substantially in mutual contact in the tip portions.

The present invention also provides a method of manufacturing an X-ray image intensifier, comprising the step of forming an input screen by forming a phosphor layer having columnar crystals on a substrate, followed by forming a photocathode on the phosphor layer, wherein the tip portions of the columnar crystals are mechanically deformed after formation of the phosphor layer so as to allow the deformed tip portions to close the upper portions of the clearances between the columnar crystals.

In the present invention, the pin holes in the surface region of the phosphor layer included in the input screen are eliminated, making it possible to prevent diffusion and dissipation of the material forming the photocathode. It follows that the initial sensitivity of the photocathode can be improved. Also, deterioration with time of the photocathode can be prevented in the present invention.

DETAILED DESCRIPTION OF THE PREFERRED EMBODIMENTS

Figure 1A:
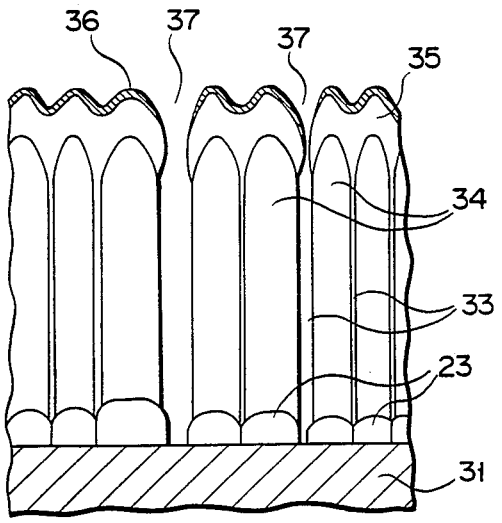
FIG. 1A (PRIOR ART)
FIG. 1A is a cross sectional view showing in a magnified fashion the gist portion of the input screen of a conventional X-ray image intensifier.
Figure 1B:
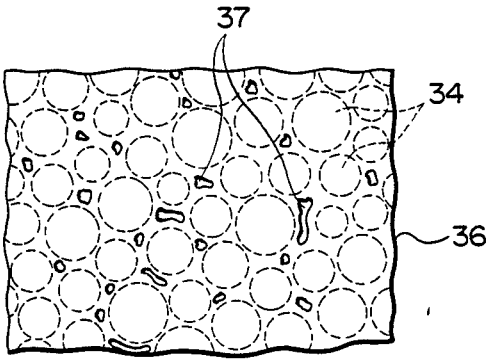
FIG. 1B (PRIOR ART)
FIG. 1B shows the surface condition of the input screen of the conventional X-ray image intensifier shown in FIG. 1A.
Figure 2:
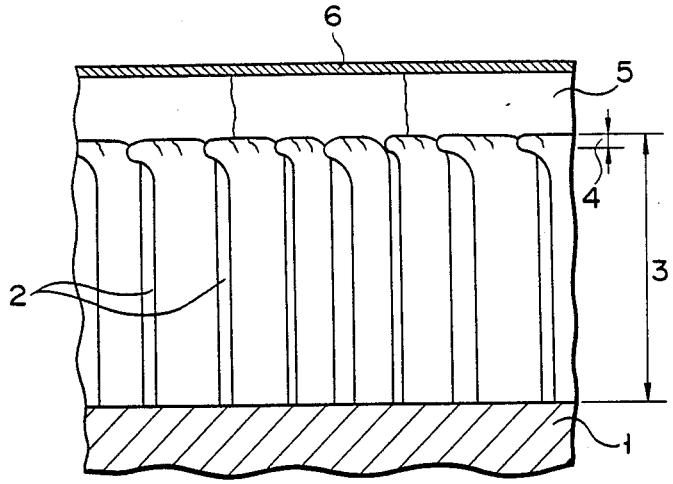
FIG. 2 is a cross sectional view showing in a magnified fashion the input screen included in an X-ray image intensifier according to one embodiment of the present invention.

The present invention is directed to an improvement in the input screen of an X-ray image intensifier, as described below with reference to the accompanying drawings. In the present invention, the input screen comprises substrate 1, phosphor layer 3 formed on substrate 1, and photocathode 6 formed on phosphor layer 3, as shown in FIG. 2. Surface layer 5, which is equal to phosphor layer 3 in the material, can be formed between phosphor layer 3 and photocathode 6. Phosphor layer 3 consists of columnar crystals extending in a direction perpendicular to the substrate surface. As seen from the drawing, columnar clearances 2 are left between the columnar crystals. It is important to note that the tip portions of the columnar crystals are mechanically deformed, with the result that the tip portions of clearances 2 are filled with the deformed tip portions of the columnar crystals so as to form continuous layer 4.

Figure 3:
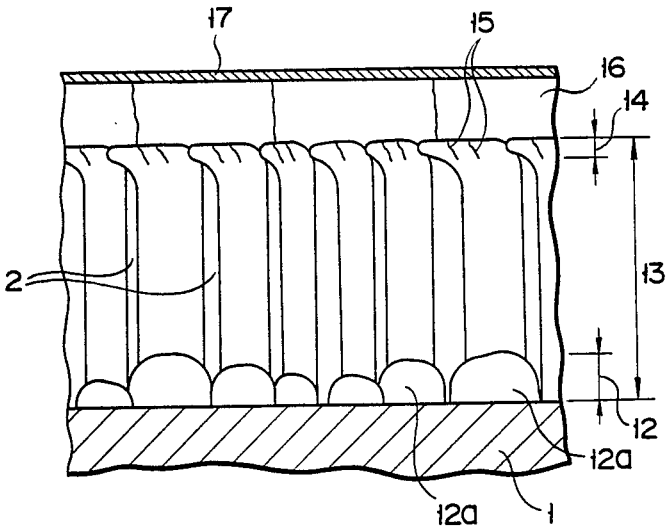
FIG. 3 is a cross sectional view showing in a magnified fashion the input screen included in an X-ray image intensifier according to another embodiment of the present invention.

Substrate 1 is formed of aluminum or glass, as in the prior art. Phosphor layer 3 is formed of a phosphor for X-ray such as CsI:Na. As shown in FIG. 3, phosphor layer 3 preferably consists of first granular phosphor layer **12*a* and second columnar phosphor layer 13*a* formed on first layer 12*a*. Photocathode 6 may be formed of a compound between Sb and an alkali metal such as $(Cs)Na_2KSb$ or $K_2CsSb$. In the case of using, for example, $K_2CsSb$ for forming the photocathode, the photocathode itself exhibits a high electrical resistance. In such a case, it is possible to form a conductive intermediate layer between phosphor layer 3 or surface layer 5 and photocathode 6**. The intermediate layer can be formed of a highly transparent indium oxide or indium tin oxide.

In manufacturing the input sereen, phosphor crystals of, for example, CsI:Na are grown in a columnar form on substrate 1 by vapor deposition. The tip portions of the columnar crystals thus grown are mechanically subjected to plastic deformation so as to form a substantially continuous surface on phosphor layer 3, followed by forming photocathode 6 on phosphor layer 3.

The continuous surface can be formed by polishing the surface of phosphor layer 3 by using a polishing apparatus. Alternatively, a plurality of balls of, for example, stainless steel having a diameter of 0.1 to 2.0 mm are put on the upper surface of the phosphor layer. Under this condition, the balls are tumbled by vibrating the substrate so as to deform the tip portions of the columnar crystals.

Figure 4A:
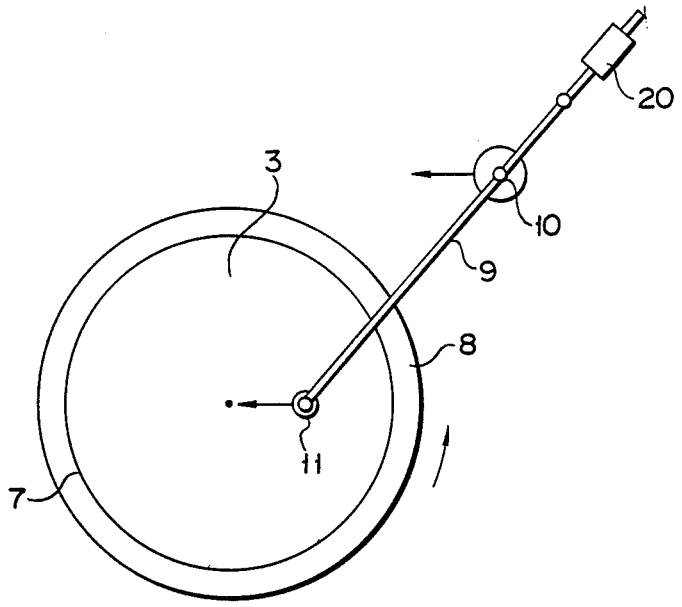
FIGS. 4A and 4B schematically show an apparatus for polishing the input phospher layer included in the X-ray image intensifier of the present invention.
Figure 4B:
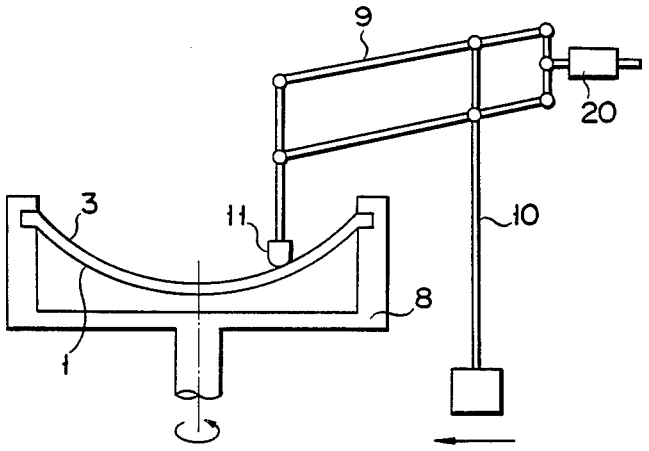

FIGS. 4A and 4B collectively show a polishing apparatus. As seen from the drawings, the apparatus comprises turntable 8, polishing tool 11, arm 9 movable in the vertical direction, counterbalancer 20, and shaft 10 supporting arm 9 and movable toward and away from the center of turntable 8. Substrate 1 having phosphor layer 3 formed thereof is fixed to turntable 8. Polishing tool 11 can be moved from the center toward a desired peripheral portion of turntable 8 by moving shaft 10. Further, the pressure applied by polishing tool 11 to the surface of the phosphor layer can be controlled by moving counterbalancer 20. It should be noted in conjunction with the pressure control referred to above that the luminance brightness in the output screen of a conventional X-ray image intensifier is distributed in general such that the luminance brightness is gradually decreased from the central portion toward the periphery even if an input X-ray incident onto the X-ray input screen has a uniform intensity over the entire region including the central and peripheral portions. In order to make the luminance brightness uniform over the entire region of the output screen of the X-ray image intensifier, the pressure applied by the polishing tool to the phosphor layer is made higher in the peripheral portion than in the central portion in the present invention. As a result, the surface region of the phosphor layer is made more smooth in the peripheral portion, leading to an improved sensitivity in the peripheral portion.

Figure 5:
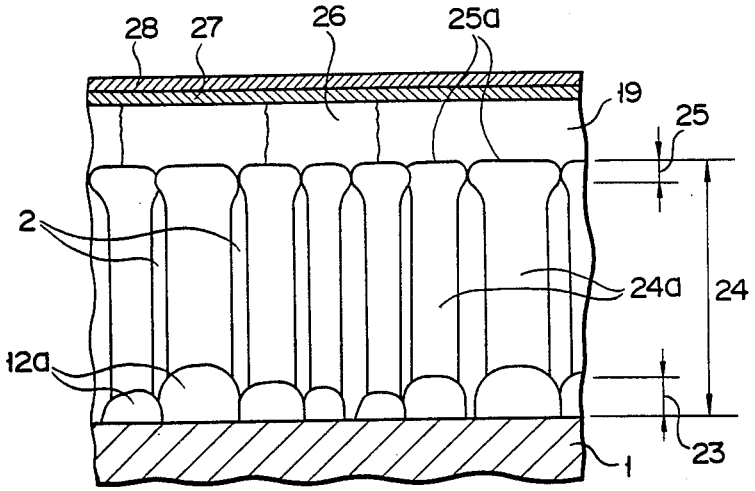
FIG. 5 is a cross sectional view showing in a magnified fashion the gist portion of the input screen according to another embodiment of the present invention.

In the case of applying the polishing, the tip portions of columnar crystals **13*a* are plastically deformed in one direction in the shape of a hook as shown in FIG. 3. On the other hand, the tip portions are deformed in every direction in the shape of a nail head in the case of tumbling, as shown in FIG. 5. When polishing and tumbling are employed in combination, columnar crystals deformed in these two different fashions are included in phosphor layer 3**.

Fine cracks 15 sized 0.1 micron or less may be included in the continuous surface region of the phosphor layer while the plastic deformation treatment described above is applied to the columnar phosphor layer. However, it is possible to close completely the fine cracks 15 by forming surface layer 5 having a thickness of 1 micron or more on surface of phosphor layer 3. Of course, surface layer 5 has a smooth surface, even if viewed microscopically.

Additional methods can be employed for forming a smooth surface of the phosphor layer. For example, it is possible to use an apparatus in which a polishing tool itself is rotated or vibrated. Further, a wet polishing method is effective. In this case, a liquid which is incapable of dissolving the phosphor layer such as alcohol solution may be interposed between the polishing tool and the input phosphor screen during the polishing step. The presence of such a liquid serves to lower the friction coefficient between the polishing tool and the input phosphor screen, making it possible to obtain a smooth surface. Still further, polishing may be applied first to fill the pin holes to some extent, followed by impregnating the polishing tool with a small amount of a liquid capable of dissolving CsI such as water or ethyl acetate and subsequently applying a final polishing. In this case, fine cracks sized 0.1 micron or less are not generated in the surface region of the CsI phosphor layer. Since the CsI phosphor layer has a very smooth surface even if viewed microscopically, it is possible to form a photocathode directly on the phosphor layer. Of course, it is possible to form a conductive protective layer about 0.1 micron in thickness on the phosphor layer, followed by forming the photocathode on the protective layer.

Mechanical deformation methods other than the polishing and tumbling methods described above can be employed in the present invention. For example, it is possible to depress the phosphor layer surface by using rolling elements such as rollers. It is also possible to employ a shot blasting method under a soft pressure.

EXAMPLE 1

Figure 6:
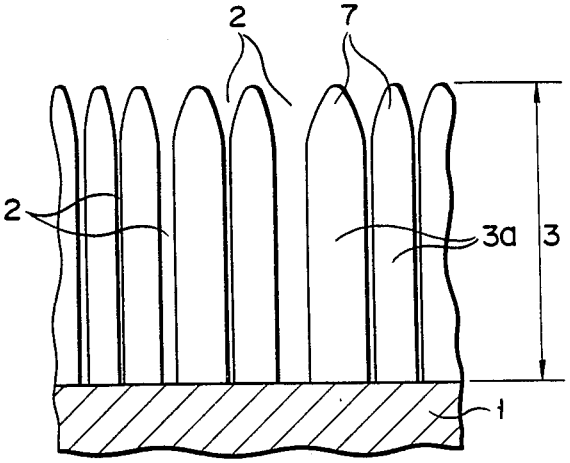
FIG. 6 is a cross sectional view showing in a magnified fashion columnar crystals formed on the input substrate by vapor deposition.

CsI:Na phosphor layer 3 was formed by vapor deposition on aluminum substrate 1, as shown in FIG. 6. Phosphor layer 3, which was found to have a thickness of 400 microns and to consist of columnar crystals 3*a* each having a diameter of 5 to 10 microns and tip portion 7, exhibited an excellent resolution. Columnar crystals 3*a* were separated from each other to provide clearance 2. Under this condition, polishing was applied by using an apparatus as shown in FIGS. 4A and 4B. Specifically, input substrate 1 having deposited CsI phosphor layer 3 formed thereon was fixed to turntable 8, and turntable 8 was rotated so as to perform the polishing. In this operation, polishing tool 11 was mounted at the tip of arm 9 so as to push the surface of phosphor layer 3 with an optional pressurizing force. A woven or nonwoven fabric was used as the polishing tool. It is possible to apply the polishing along the curved surface of the input screen from the central portion toward the periphery of phosphor layer 3 by moving arm 9 together with shaft 10. In this experiment, the pressurizing force of the polishing tool was set at 200 g/cm$^2$, which is about 50% higher than the critical pressure at which the surface of phosphor layer 3 begins to be deformed. Phosphor layer 3 was gradually deformed to provide a smooth surface by the friction between polishing tool 11 and phosphor layer 3. When the deformation proceeded to provide sufficient continuous layer 4, the frictional force was reduced to ½ or less so as to stop further proceeding of the deformation. The tip portions of columnar crystals 3*a* were found to have been deformed in one direction in the shape of a hook as shown in FIG. 2. Also, fine cracks sized 0.1 micron or less were found in continuous layer 4 thus formed. After the pressurizing step, surface layer 5 consisting of CsI phosphor was formed in a thickness of 3 microns by vapor deposition under high vacuum on continuous layer 4. The average crystal size in the surface layer was about 1.5 times as large as the average diameter of columnar crystals. The positions of the crystal boundaries in the surface layer did not conform with those of the columnar crystals. The surface of surface layer 5 was substantially smooth. Further, photocathode 6 was formed on surface layer 5 so as to prepare an input screen.

The X-ray image intensifier comprising the input screen thus prepared exhibited about 50% improvement in sensitivity, compared with the conventional X-ray image intensifier. Also, the resolution was improved from the conventional value of 50 lp/cm to 52 lp/cm. Further, the MTF value at the spatial frequency of 20 lp/cm was improved from the conventional value of 24% to 27% in the X-ray image intensifier of the present invention.

EXAMPLE 2

In the first step, a first phosphor layer consisting of CsI:Na phosphor particles 12*a* having an average particle size of 10 microns was formed by vapor deposition on input substrate 1 having a smooth surface, as shown in FIG. 3. Then, columnar crystals were grown by vapor deposition with the projected tip portions of crystal particles 12*a* used as seeds so as to form second phosphor layer 13. Second phosphor layer 13, which was 400 microns in thickness and consisted of columnar crystals 13*a* having a diameter of 5 to 10 microns, exhibited an excellent resolution.

A mechanical polishing was applied as in Example 1 to the surface of second phosphor layer 13. After the polishing step, the tip portions of columnar crystals 13*a* were found to have been deformed in one direction in the shape of a hook as shown in FIG. 3. Further, fine cracks 15 sized 0.1 micron or less were found in continuous layer 14 formed by the polishing treatment. Then, surface layer 16 was formed in a thickness of about 3 microns on continuous layer 14. Surface layer 16 was found substantially smooth. Finally, photocathode 17 was formed on surface layer 16 so as to prepare an input screen.

The X-ray image intensifier comprising the input screen thus prepared exhibited about 50% improvement in sensitivity, compared with the conventional X-ray image intensifier. Also, the resolution was improved from the conventional value of 50 lp/cm to 52 lp/cm. Further, the MTF value at the spatial frequency of 20 lp/cm was improved from the conventional value of 24% to 27% in the X-ray image intensifier of the present invention.

EXAMPLE 3

First and second phosphor layers were formed as in Example 2, followed by putting metal balls, not shown, having a diameter of 0.5 mm on the surface of the second phosphor layer consisting of columnar crystals 24. Under this condition, substrate 1 was vibrated for about 10 minutes so as to tumble the metal balls and, thus, to form continuous layer 25 consisting of tip portions 25*a* of columnar crystals 24. As shown in FIG. 5, the tip portions of the columnar crystals were deformed in every direction in the shape of a nail head by the tumbling operation. Continuous layer 25 thus formed was less than about 3 microns in thickness, and fine cracks sized 0.1 micron or less were found in continuous layer 25. After the tumbling step, CsI:Na phosphor layer 19 was formed in a thickness of about 3 microns on continuous layer 25. The surface of phosphor layer 19 was substantially smooth. Then, an indium oxide intermediate layer 27 about 0.1 micron in thickness was formed on phosphor layer 19, followed by forming photocathode 28 on the intermediate layer 27 so as to prepare an input screen.

The X-ray image intensifier comprising the input screen thus prepared exhibited about 50% improvement in sensitivity, compared with the conventional X-ray image intensifier. Also, the resolution was improved from the conventional value of 50 lp/cm to 52 lp/cm. Further, the MTF value at the spatial frequency of 20 lp/cm was improved from the conventional value of 24% to 27% in the X-ray image intensifier of the present invention.

EXAMPLE 4

Figure 7:
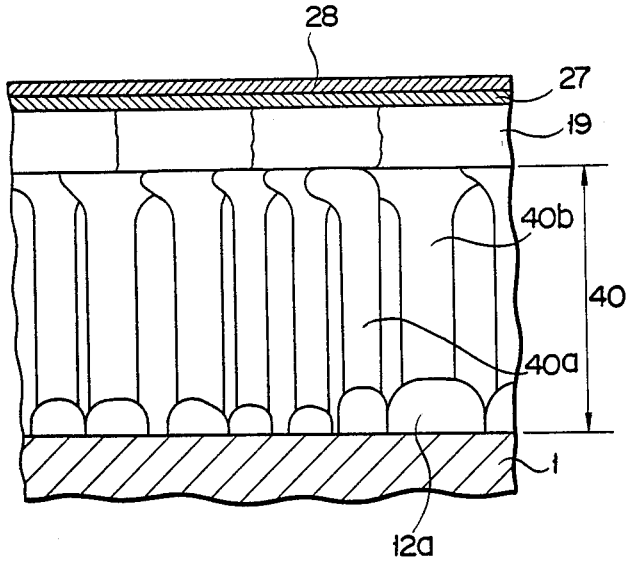
FIG. 7 is a cross sectional view showing in a magnified fashion the gist portion of the input screen included in an X-ray image intensifier according to still another embodiment of the present invention.

A phosphor layer formed as in Example 2 was mechanically polished, followed by applying a tumbling treatment as in Example 3. The resultant phosphor layer 40 was found to have included both columnar crystals **40*a* having the tip portions deformed in one direction in the shape of a hook and columnar crystals 40*b* having the tip portions deformed in every direction in the shape of a nail head, as shown in FIG. 7. Then, a surface layer 19 consisting of CsI:Na phosphor as in Example 3 was formed on phosphor layer 40. Surface layer 19 was substantially smooth. Further, intermediate layer 27 and photocathode 28 were successively formed on surface layer 19** so as to prepare an input screen. The X-ray image intensifier comprising the input screen thus prepared was substantially equal in performance to that in Example 3.

EXAMPLE 5

A surface layer about 1 micron thick was formed on the phosphor layer to which a mechanical polishing had been applied as in Example 1. A transparent material other than the phosphor material, i.e., LiF, NaF, CsF, $CaF_2$, $MgF_2$ or $SiO_2$, was used for forming the surface layer. The surface layer was substantially smooth. Then, a photocathode was formed on the surface layer so as to prepare an input screen.

The X-ray image intensifier comprising the input screen thus prepared exhibited about 30% improvement in sensitivity, compared with the conventional X-ray image intensifier. Also, the resolution was improved from the conventional value of 50 lp/cm to 54 lp/cm. Further, the MTF value at the spatial frequency of 20 lp/cm was improved from the conventional value of 24% to 30% in the X-ray image intensifier of the present invention.

As described above, the input screen included in the X-ray image intensifier of the present invention comprises a phosphor layer having a smooth surface. Since pin holes are not formed in the surface region of the phosphor layer, it is possible to prevent the material constituting the photocathode positioned on the phosphor layer from being diffused or dissipated through the pin holes of the phosphor layer, leading to an improved sensitivity of the photocathode.

What is claimed is:

1. An X-ray image intensifier comprising a vacuum envelope and an input screen which includes a substrate disposed on the X-ray input side within the vacuum envelope, a phosphor layer formed on the substrate, and a photocathode formed on the phosphor layer, said phosphor layer consisting of columnar crystals extending in a direction perpendicular to the substrate surface, and the tip portions of said columnar crystals being deformed to close the tip portions of the clearances formed between the columnar crystals.

2. The X-ray image intensifier according to claim 1, wherein a surface layer having a smooth surface is formed on the phosphor layer.

3. The X-ray image intensifier according to claim 2, wherein the surface layer is formed of phosphor crystals.

4. The X-ray image intensifier according to claim 3, wherein the average crystal size in the surface layer is at least 1.5 times as large as the average diameter of the columnar crystals.

5. The X-ray image intensifier according to claim 2, wherein the surface layer is formed of at least one transparent material selected from the group consisting of alkali metal halide compound, alkaline earth metal halide compound, $Al_2O_3$ and $SiO_2$.

6. The X-ray image intensifier according to claim 1, wherein a conductive intermediate layer is formed between the phosphor layer and the photocathode.

7. The X-ray image intensifier according to claim 6, wherein the conductive intermediate layer is formed of indium oxide or indium tin oxide.

8. The X-ray image intensifier according to claim 1, wherein the phosphor layer consists of a first phosphor layer consisting of granular crystals and formed on the substrate by vapor deposition and a second phosphor layer grown in a columnar shape on the first phosphor layer.

9. An X-ray image intensifier, comprising a vacuum envelope and an input screen which includes a substrate disposed on the X-ray input side within the vacuum envelope, a phosphor layer having columnar crystals formed on the substrate, and a photocathode formed on the phosphor layer, the tip portions of the columnar crystals having a cross sectional area larger than that of the other portion and being substantially in mutual contact.

10. The X-ray image intensifier according to claim 9, wherein the tip portions of the columnar crystals are deformed in one direction in the shape of a hook.

11. The X-ray image intensifier according to claim 9, wherein the tip portions of the columnar crystals are deformed in every direction in the shape of a nail head.

12. A method of manufacturing an X-ray image intensifier comprising an input screen, in which the input screen is prepared by the steps of forming a phosphor layer having columnar crystals on a substrate by vapor deposition; mechanically deforming the tip portions of the columnar crystals to allow the deformed tip portions to fill the upper portions of the clearances between the columnar crystals, thereby forming a continuous surface in the tip portions of the columnar crystals; and forming a photocathode on the phosphor layer.

13. The method according to claim 12, which further comprises the step of forming a smooth surface layer on the phosphor layer to obtain a smooth surface.

14. The method according to claim 13, wherein the average crystal size in the surface layer is at least 1.5 times as large as the average diameter of the columnar crystals.

15. The method according to claim 13, wherein the surface layer is formed of at least one transparent material selected from the group consisting of alkali metal halide compound, alkaline earth metal halide compound, $Al_2O_3$ and $SiO_2$.

16. The method according to claim 12, wherein a conductive intermediate layer is formed on the continuous surface of the phosphor layer, followed by forming the photocathode on the conductive intermediate layer.

17. The method according to claim 12, wherein the continuous surface is formed by mechanically polishing the tip portions of the columnar crystals by using a polishing apparatus.

18. The method according to claim 17, wherein the pushing force of the polishing tool of the polishing apparatus is set greater in the peripheral portion than in the central portion of the substrate so as to form a continuous surface polished such that the continuous surface is smoother in the peripheral portion than in the central portion.

19. The method according to claim 12, wherein the continuous surface is formed by putting a plurality of balls on the tip portions of the columnar crystals, followed by vibrating the substrate so as to tumble the balls.

* * * * *